US005411672A

United States Patent [19]

Kagaya et al.

[11] Patent Number: 5,411,672

[45] Date of Patent: May 2, 1995

[54] LUBRICATION OIL COMPOSITION

[75] Inventors: Mineo Kagaya, Fujisawa; Mitsuaki Ishimaru, Kanagawa; Hiroaki Ishii, Kawasaki, all of Japan

[73] Assignee: Nippon Oil Co., Ltd., Tokyo, Japan

[21] Appl. No.: 149,973

[22] Filed: Nov. 10, 1993

Related U.S. Application Data

[63] Continuation-in-part of Ser. No. 951,143, Sep. 15, 1992, abandoned.

[51] Int. Cl.[6] ..... C10M 105/34; C10M 105/42

[52] U.S. Cl. ..... 252/56 S

[58] Field of Search ..... 252/56 S; C10M 105/34, C10M 105/42

[56] References Cited

U.S. PATENT DOCUMENTS 3,328,302 6/1967 Critchley ..... 252/56 S 3,875,069 4/1975 Worschech et al. ..... 252/56 S

FOREIGN PATENT DOCUMENTS 971901 10/1964 United Kingdom .

*Primary Examiner*—Prince Willis, Jr.

*Assistant Examiner*—Cephia D. Toomer

*Attorney, Agent, or Firm*—Bucknam and Archer

[57] ABSTRACT

The lubricating oil composition of the present invention comprising an ester mixture as the main ingredient consisting of (A) 60–95% by weight of an ester of a hindered alcohol with a straight-chain saturated fatty acid having 8–12 carbon atoms, and (B) 5–40% by weight of a complex ester of a hindered alcohol with a straight-chain saturated fatty acid having 8–12 carbon atoms and also with a dibasic acid having 20–50 carbon atoms, the composition having excellent performances such as biodegradability, high-temperature engine cleanliness, lubricity and piston seizure preventiveness which are conductive to environmental protection.

8 Claims, No Drawings

LUBRICATION OIL COMPOSITION

This application is a continuation-in-part of Ser. No. 07/951,143 filed Sep. 15, 1992, now abandoned.

BACKGROUND OF THE INVENTION

1. Field of the Invention

The present invention relates to a lubricating oil composition and more particularly to a lubricating oil composition which is excellent in biodegradability, high-temperature cleanliness and anti-seizure performance and is therefore conductive to environmental protection.

2. Prior Art

Two-cycle engines raise problems as to possible environmental pollution since they discharge an unburned engine oil as a by-product of their exhaust gases due to their lubrication mechanism. For example, outboard engines used in rivers, lakes or oceans discharge exhaust gases containing unburned-oil into the water so that they raise problems as to water pollution due to the unburned oil. Chain saws and other forestry machinery may also cause the pollution of forests and rivers due to the unburned oil.

In Europe, there have been substantial activities in attempts to establish laws, regulations and standards concerning the biodegradability of the two-cycle engine oils from the standpoint of environmental protection. Because of this, a two-cycle engine oil having biodegradabillty has heretofore been considered to be developed and it has already been sold from several oil makers. These oils, in all cases, comprise, as a specific base oil an ester compound (based on a mixture of saturated and unsaturated fatty acid esters each having 16–18 carbon atoms) and a mineral oil-based solvent. They contain an amino amide type ashless dispersant as an additive.

These commercially available oils already passed the TC-WII which is a performance standard of oils for outboard engines. However, when these oils are used in recently manufactured high-performance water-cooled outboard engines and air-cooled engines, they are considered to raise problems as to ring sticking and piston seizure due to their insufficient thermal stability as a lubricating oil.

Because of this, a biodegradable lubricating oil having better thermal stability and more excellent lubricity has been sought.

SUMMARY OF THE INVENTION

An object of the present invention is to provide a lubricating oil having excellent performances in biodegradabllity, high-temperature cleanliness, lubricity and anti-seizure performance.

Another object is to provide a method for lubrication comprising the use of such a lubricating oil as above.

The present inventors made intensive studies to aim mainly at solving the above problems and, as the result of their studies, they found out that a lubricating oil comprising predetermined esters as main components satisfies the above-mentioned requirements, thus achieving the present invention.

More particularly, in a first aspect of the present invention, a lubricating oil composition comprises as the main component an ester mixture consisting of (A) 60–95% by weight of an ester of a hindered alcohol with a straight-chain saturated fatty acid having 8–12 carbon atoms, and (B) 5–40% by weight of a complex ester of a hindered alcohol with a straight-chain saturated fatty acid having 8–12 carbon atoms and also with a dibasic acid having 20–50 carbon atoms.

In a second aspect of the present invention, a lubricating oil composition comprises (I) 100 parts by weight of an ester mixture consisting essentially of (A) 60–95% by weight of an ester of a hindered alcohol and a straight-chain saturated fatty acid having 8–12 carbon atoms, and (B) 5–40% by weight of a complex ester of a hindered alcohol with both a straight-chain saturated fatty acid having 8–12 carbon atoms and a dibasic acid having 20–50 carbon atoms, and (II) not more than 30 parts by weight of a hydrocarbon-based solvent and/or a lubricating base oil.

DETAILED EXPLANATION OF THE INVENTION

The present invention will now be explained hereunder in more detail.

The ester mixture used in the present invention as the main ingredient is a mixture of (A) an ester of a hindered alcohol and a straight-chain saturated fatty acid having 8–12 carbon atoms, and (B) a complex ester of a hindered alcohol with both a straight-chain saturated fatty acid having 8–12 carbon atoms and a dibasic acid having 20–50 carbon atoms.

In the preparation of this component (A), the hindered alcohol used means one in which the carbon atom which is $\beta$ to the hydroxyl group is a quaternary carbon atom. More specifically, the hindered alcohol preferably used include dihydric to tetrahydric alcohols having 5–10 carbon atoms, and a dimer and trimer thereof, and they are exemplified by neopentyl glycol, 2-methyl-2-propyl-1, 3- propanedlol, trimethylol ethane, trimethylol propane (TMP), trimethylol butane, pentaerythritol (PET), di- (trimethylol propane), tri(trimethylol propane), di- (pentaerythrltol) and tri(pentaerythritol). In these hindered alcohol, neopentyl glycol, TMP and PET are preferably used.

The straight-chain saturated fatty acid having 8–12 carbon atoms used in the present invention include caprylic acid, pelargonic acid, capric acid and lauric acid. Furthermore, such fatty acids may be used in the form of a derivative such as an acid anhydride, acid halide and metal salt of the acids. In the preparation of the component (A), at least two different acids among these fatty acids may be esterified with the same hindered alcohol, or the resulting ester may have a hydroxyl group therein which remains without being esterified.

In the preparation of the component (B), the same hindered alcohol and the saturated fatty acid having 8–12 carbon atoms as those used in the preparation of the above component (A) may be employed. The dibasic acids used in said preparation are those having 20–50, preferably 30–50 and more preferably 30–40 carbon atoms. In the case where the dibasic acids of less than 20 carbon atoms are used, the resulting lubricating oil is poor in high-temperature cleanliness. In a case where the dibasic acids of larger than 50 carbon atoms are used, the resulting lubricating oil will undesirably be insufficient in fluidity.

The component (B) may be exemplified by a complex ester represented by the following general formula (I).

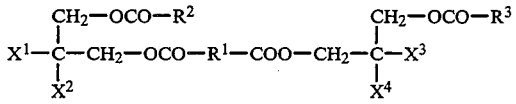

(I)

wherein $X^1$ to $X^4$ may be identical with or different from each other and each represent an alkyl group having 1–4 carbon atoms or a group having the following general formula of $—CH_2—OCO—R^4$ ($R^4$ being an alkyl group having 7–11 carbon atoms). Also, in the formula (I), $R^1$ represents a straight or branched alkylene or alkenylene group having 18–48 carbon atoms. $R^2$ to $R^4$ may be identical with or different from each other and each represent a straight-chain alkyl group having 7–11 carbon atoms. In this case, $R^1$ corresponds to the alkylene group of a dibasic acid having 20–50 carbon atoms, $R^2$ to $R^4$ each correspond to the alkyl group of a straight-chain saturated fatty acid having 8–12 carbon atoms.

In this invention, the content of the above component (A) is 60 to 95%, preferably 70 to 90%, by weight based on the total weight of the specific base oil. The content of the above component (B) is 5 to 40%, preferably 10 to 30%, by weight based on the total weight of the specific base oil. When the contents of the above components (A) and (B) do not fall respectively within the above ranges, the resulting composition will not be appropriate in viscosity. In addition, when the content of the above component (B) exceeds 40% by weight, the resulting composition will undesirably be insufficient in biodegradability. Furthermore, the composition of the present invention shoud have a kinematic viscosity of preferably 6 to 15 $mm^2/s$ at a temperature of 100° C. In the case where the kinematic viscosity is less than 6 $mm^2/s$ at a temperature of 100° C., the resulting composition is poor in lubricity and anti-seizure performance. On the other hand, in the case where the kinematic viscosity exceeds 15 mm/s at a temperature of 100° C., the resulting composition will undesirably be insufficient in fluidity.

The lubricating oil composition of the present invention may contain the above ester mixture alone, and, however, it may further contain a known hydrocarbon-based solvent and/or a known lubricating base oil as required. This hydrocarbon-based solvent may be one which is usually used for two-cycle engine oils, and it is exemplified by a petroleum-based hydrocarbon solvent and/or a synthesized hydrocarbon solvent each having a boiling point of 150° to 300° C. at atmospheric pressure. Specifically, these solvents are illustrated by Stoddard solvent, mineral spirits, kerosene fractions, n-paraffins, i-paraffins and propylene oligomers.

The lubricating base oil may be one which is usally used as a base oil for lubricating oils and it is exemplified by paraffinic and naphthenic mineral oils prepared by refining lubricating oil fractions which are obtained by distilling crude oils under atmospheric or a reduced pressure; poly-α-olefin (1-octene oligomer, 1-decene oligomer, etc.); polybutene, alkylbenzenes; alkylnaphthalenes; polyglycol; diester (ditridecylgultarate, di,2-ethylhexyl adipate); diisodecyl adipate; di,tridecyl adipate; di,2-ethyl hexyl cebacate; esters of polyol with a straight-chain chain fatty acid having up to 7 or at least 13 carbon atoms or with a branched-chain fatty acid (trimethylolpropane stearate, trimethylolpropane oleate, pentaerithritol 2-ethylhexanoate, etc.); polyphenylether; fluorine-based oils; and silicone-based oils.

In the case where the solvent and/or a lubricating base oil other than the above-mentioned ester mixture (the specific base oil) are/is to be added to the ester mixture, it is preferable to add the solvent and/or the lubricating base oil in a total amount of up to 30 parts, preferably up to 20 parts, by weight per 100 parts by weight of the specific base oil consisting of the ester mixture so as not to deteriorate the excellent thermal stability, lubricity and also biodegradability which are the features of this invention.

Moreover, the composition of this invention may be incorporated with various kinds of known additives for the purpose of further improving the performance of the composition, as required. The additives include basic calcium sulfonate, basic calcium phenate, basic calcium salicylate, alkenyl succinic acid imide, benzyl amine, a detergent such as a polyalkenyl amine, a pour point depressant such as polymethacrylate, a rust preventing agent and anti-foaming agent.

These additives may be added alone or jointly. They may be added in any optional amount and, usually, they may each be added in an amount of up to 30, preferably 0.5–15, parts by weight per 100 parts by weight of the specific base oil.

Although the lubricating oil compositions of this invention are suited especially for two-cycle engines such as outboards and chain saws since they are excellent in biodegradability, they are preferably used in engines for two-wheeled vehicles such as mopet (motorlike) and motorcycles, and in portable power unit engines for lawnmowers and power generators. The lubricating oil compositions of this invention are used preferably for two-cycle engines of a mixed lubrication type. Furthermore, they can be used as a four-cycle engine oil, a hydraulic oil, a gear oil and a metal processing oil.

THE PREFERRED EMBODIMENTS

The present invention will be better understood by way of Examples and Comparative examples, and, however, it is not limited to these Examples.

1. biodegradability and thermal stability

The biodegradability and thermal stability which are fundamental performances of this invention were evaluated.

(1) biodegradability

The biodegradability was measured by the coulometer method using a closed-system oxygen consumption measurement apparatus, and this method is usually called the MITI method which is one of the test methods prescribed by the Chemical Substances Control Law in Japan. This method is the one in which incubation is effected at a temperature of 25° C. for a period of time of 14 days.

A decomposition degree is represented by the following formula.

Decomposition degree $=[(BOD-B)/TOD]\times 100$

BOD: Biological Oxygen Demand of a test substance (Value found, mg)

B: Oxygen consumption of a culture medium into which activated sludge has been inoculated (Value found, mg)

TOD: Theoretical Oxygen Demand required for complete oxidation of the test substance (Value calculated, mg). The value for T0D was determined by calculating the molecular formula obatined from the elemental analysis of the test substance (oil).

A test substance which showed a decomposition degree of 35 to 40% in this test is considered to have undergone almost complete biodegradation. The compositions of this invention showed a decomposition degree of 35 to 60% in this test and therefore the biodegradability standard for the compositions of this invention has been determined in conformity with said decomposition degree.

(2) Thermal stability

Thermal stability was evaluated by a hot tube test (HTT) (This test is described in SAE Paper 881619, 1988). This test was carried out by installing a glass tube into an electric furnace and then pushing a test oil upward with air through the glass tube. The oil was degraded by being subjected to heat and oxidation when it passed through the glass tube. In this test, a merit rating is represented by the shade of lacquer-like color of a deposit to the inner wall of the glass tube. The merit rating is between 10 points when no deposit is found, and 0 point when a deposit looks black in color. Because there is comparatively good correlation between piston cleanliness found by engine tests and HTT merit rating, the HTT is utilized as a screening test before subjecting to an engine test. The compositions of this invention were produced so that they would exhibit a HTT merit rating of at least 5 points at 280° C., 16 hrs as their standard.

The test results thus obtained are shown in Table 10 1.

Examples 1, 2 and 3 which show compositions of this invention, exhibited excellent performances in biodegradability and thermal stability as compared with Comparative Examples which show comparative compositions.

(1) Comparative Example 1 is a TMP ester which consists mainly of a fatty acid (oleic acid) having 18 carbon atoms. This ester exhibited good biodegradability, and, however, it was poor in thermal stability as compared the composition of the present invention.

(2) Comparative Example 2 is a PET ester which consists of a branched-chain fatty acid having 8 carbon atoms. This PET ester exhibited low biodegradability although it exhibited good thermal stability.

(3) Comparative Examples 3 and 4 used therein oils alone which were the same as the components (A-1) and (A-2) of this invention, respectively. Each of these oils exhibited good biodegradability and thermal stability. However, in the case where each of said oils is used alone as a lubricating oil, it exhibits a kinematic viscosity of less than 6 $mm^2/s$ at 100° C. These oils are not suited as a base oil for a two-cycle engine oil due to very low viscosity, insufficient lubricity and insufficient anti-seizure performance. The high-temperature cleanliness test of these oils could not be carried out because there was in danger of damage of engine. In addition, Comparative Example 5 used therein an oil alone which was the same as the component (B) of this invention. Unlike the oils in Comparative Examples 3 and 4, the oil alone in Comparative Example 5 exhibited a kinematic viscosity of higher than 30 $mm^2/s$ at 100° C. and raised prob-

TABLE 1

| | Component (A) wt. % | | Component (B) wt. % | | Other oils, parts by weight based on 100 parts by weight of (A) + (B) | | Additives, parts by weight based on 100 parts by weight of (A) + (B) | | Test result of biodegrability (MITI method) decomposition degree % | Test result of HTT at 280° C., for 16 hrs. the best = 10, the worst = 0 |
|---|---|---|---|---|---|---|---|---|---|---|
| | A-1 | A-2 | B-1 | B-2 | | | | | | |
| Example | | | | | | | | | | |
| Ex. 1 | 95 | — | 5 | — | | 0 | ashless dispersant A | 20 | 39 | 7 |
| Ex. 2 | — | 80 | 20 | — | diluent | 10 | ashless dispersant B | 15 | 45 | 8 |
| Ex. 3 | 80 | — | 20 | — | diluent | 5 | ashless dispersant B | 15 | 51 | 7 |
| Comp. Example | | | | | | | | | | |
| Comp. Ex. 1 | 100 wt. % of TMP ester consisting mainly of fatty acid having 18 carbon atoms | | | | | | | | 45 | 3 |
| Comp. Ex. 2 | 100 wt. % of PET ester consisting of fatty acid having 8 carbon atoms and iso-structure | | | | | | | | 3 | 10 |
| Comp. Ex. 3 | (A-1) 100 wt. % | | | | | | | | 45 | 10 |
| Comp. Ex. 4 | (A-2) 100 wt. % | | | | | | | | 40 | 10 |
| Comp. Ex. 5 | (B-1) 100 wt. % | | | | | | | | 24 | 10 |
| Comp. Ex. 6 | (A-1) 50 wt. %, (B-1) 50 wt. % | | | | | | | | 30 | 10 |
| Comp. Ex. 7 | commercially available biodegradable two-cycle engine oil-1 | | | | | | | | 43 | 0 |
| Comp. Ex. 8 | commercially available biodegradable two-cycle engine oil-2 | | | | | | | | 40 | 0 |
| Comp. Ex. 9 | commercially available low-smoke exhaust gas type two-cycle engine oil-1 | | | | | | | | 8 | 10 |
| Comp. Ex. 10 | commercially available mineral base oil for two-cycle engine oil | | | | | | | | 14 | 3 |
| Comp. Ex. 11 | commercially available low-smoke exhaust gas type two-cycle engine oil-2 | | | | | | | | 10 | 3 |
| Comp. Ex. 12 | 80 | — | — | 20 | diluent | 5 | ashless dispersant B | 15 | 48 | 7 |

Notes:
ashless dispersant A: bis type succinimide
ashless dispersant B: benzyl amine + aminoamide
ashless dispersant C: bis type succinimide
metallic detergent: basic calcium sulfonate
(A-1): TMP ester of saturated fatty acid having 8–12 carbon atoms
(A-2): PET ester of saturated fatty acid having 8–12 carbon atoms
(B-1): TMP complex ester consisting of saturated fatty acid having 8–12 carbon atoms and dibasic acid having 36 carbon atoms
(B-2): TMP complex ester consisting of saturated fatty acid having 8–12 carbon atoms and dibasic acid having 10 carbon atoms
diluent: kerosine lems as to its detergency and fluidity. In addition, this Comparative Example 5 did not satisfy the decomposition degree of 35% to be requested in connection with the biodegradability.

(4) Comparative Example 6 used therein an oil prepared by mixing the components (A) and (B) of this invention. The oil so prepared exhibited inferior biodegradability since the mixing ratio was outside that specified for the composition of this invention.

(5) Comparative Examples 7 and 8 show commercially-available biodegradable two-cycle engine oils respectively. These oils use therein the same ester as used in Comparative Example 1 as a main component of the base oil. In contrast with these Comparative Examples, it is apparent that the compositions of this invention shown in Examples 1 to 3 were remarkably improved in thermal stability. In addition, Comparative Example 9 shows a polybutene base oil for commercially-available low-smoke exhaust gas type two-cycle engine oil. This polybutene base oil exhibits good thermal stability in the HTT, but it has low biodegradability. Comparative Example 10 shows a mineral base oil for two-cycle engine oil, and Comparative Example 11 shows an oil for commercially-available low-smoke exhaust gas type two-cycle engine oil, in which the base oil has partly been replaced with a polybutene base oil. Such a mineral base oil is poor in both thermal stability and biodegradability.

(6) Comparative Example 12 is the same as Example 3 except that the dibasic acid having 10 carbon atoms was used and shows good results in both thermal stability and biodegradability. Such a lubricating oil composition is poor in high-temperature cleanliness as is poor in high-temperature cleanliness as apparent from the result of the subsequent engine test.

(7) As shown in the Examples, the composition of this invention comprises the components (A) and (B) in the specified mixing ratio thereby enabling the composition to have a suitable range of viscosity which is required in two-cycle engine oils, and also to exhibit excellent lubriclty as well as excellent biodegradability and thermal stability which are important properties of the composition of this invention.

2. Engine test results (1) High-temperature cleanliness test on motorcycle engines Using an air-cooled two-cycle, 1-cylinder engine having a displacement of 123 c.c. for motorcycles, a high-temperature cleanliness test was carried out under conditions of an engine speed of 7000 rpm, full engine load, a plug gasket temperature of 260° C., a fuel:oil mixing ratio of 20:1 and testing time of 3 hrs.

As shown in Table 2, the composition of this invention in Example 3 was excellent in anti-seizure performance between the piston and the cylinder as compared with Comparative Examples 7 and 8 which were commercially-available biodegradable two-cycle engine oils. This composition of Example 3 was also extremely excellent in piston cleanliness without ring sticking after the test.

TABLE 2

| Test oils | Ex. 3 | Comp. Ex. 7 | Comp. Ex. 8 | Comp. Ex. 12 |
|---|---|---|---|---|
| ring sticking, | | | | |
| top ring | 10 | 0 | 6 | 8 |
| second ring | 10 | 0 | 6 | 8 |
| ring land, | | | | |
| top | 4.1 | 1.5 | 3.8 | 3.0 |
| second | 5.6 | 0.3 | 4.1 | 4.8 |
| piston skart | 9.4 | 5.3 | 9.2 | 5.9 |
| undercrown | 2.9 | 0.6 | 2.0 | 1.8 |
| Total: 60 points (full marks) | 42.0 | 7.7 | 33.1 | 31.5 |

Note: Since the piston seizure took place in 2.5 hours in Comparative Example 7, Comparative Example 7 shows the piston cleanliness at that time.

(2) Cleanliness test on engine for electric generator

Using a 1-cylinder engine employed for a generator and having a displacement of 63 cc, an engine cleanliness test was made under conditions of full engine load (800 W) and testing time of 5 hrs. A plug gasket temperature was set at 200° C. by covering about 50% of the air intake of a forced cooling fan. The test was carried out at a fuel:oil mixing ratio of 50:1 (mixing lubrication).

As shown in Table 3, the composition of Example 3 according to this invention was excellent in piston cleanliness without causing ring sticking as compared with Comparative Example 7 which was a commercially available biodegradable two-cycle engine oil and with Comparative Example 10 which has a mineral base oil. The composition of Example 3 was also extremely low in cylinder head deposits.

TABLE 3

| Test oils | Ex. 3 | Comp. Ex. 7 | Comp. Ex. 10 |
|---|---|---|---|
| ring sticking, | | | |
| top ring | 10 | 8 | 10 |
| second ring | 10 | 10 | 10 |
| ring land, | | | |
| top | 6.7 | 1.0 | 1.6 |
| second | 8.2 | 5.3 | 4.4 |
| piston skart | 10 | 9.3 | 9.2 |
| undercrown | 10 | 2.2 | 1.6 |
| cylinder head | 10 | 8.9 | 5.7 |
| Total: 70 points (full marks) | 64.9 | 44.7 | 42.5 |

(3) Engine cleanliness test on chain saw engine

An engine cleanliness test was carried out on a 1-cylinder engine used for a chain saw engine and having a displacement of 45 cc, under conditions of an engine speed of 9000 rpm, full engine load, a plug gasket temperature of 280° C., a fuel:oil mixing ratio of 50:1 and testing time of 30 hrs (mixing lubrication).

As shown in Table 4, the composition of Example 3 according to this invention was extremely excellent in ring sticking resistance and piston cleanliness as compared with Comparative Example 11 which was an oil for a commercially-available low-smoke type two-cycle engine oil.

TABLE 4

| Test oils | Ex. 3 | Comp. Ex. 11 |
|---|---|---|
| ring sticking, | | |
| top ring | 7.0 | 5.0 |
| second ring | 10 | 10 |
| ring land, | | |
| top | 8.4 | 3.9 |
| second | 9.5 | 5.2 |
| piston skart | 10 | 9.0 |
| undercrown | 2.4 | 0.9 |
| Total: 60 points (full marks) | 47.3 | 34.0 |

As described above, several points of excellent performances of the composition according to this invention were illustrated in the tests, and, further, the same results were obtained even in other engine tests. In addition, the composition of this invention has already passed the TC-WII which is a standard of NMMA (National Marine Manufacturers Association) for two-cycle engine oils for use in outboard engines and has also passed the CEC L-33-T-82 which is a test method of evaluating biodegradability of two-cycle engine oils for outboard engines (the method of biodegradability test is different from the MITI method of Japan) and which indicates that a standard of the biodegradability is at least 67% (for example, Example 3 exhibited a decomposition degree of 87%, and, on the other hand, Comparative Example 7 showed 67% in this test method).

Effects of the present invention

As will be understood from the above, the composition according to this invention is a lubricating oil which can solve the problems as to the piston ring sticking and piston seizure which have become problems in the market.

What is claimed is:

1. A method of lubricating a two-cycle engine which consists of a) mixing (A) 60–95% by weight of an ester of a hindered alcohol with a straight-chain saturated fatty acid having 8–12 carbon atoms with (B) 5–40% by weight of a complex ester of a hindered alcohol with a straight-chain saturated fatty acid having 8–12 carbon atoms and also with a dibasic acid having 20–50 carbon atoms to obtain a mixture and b) applying said mixture to said two-cycle engine.

2. A method of lubricating a two-cycle engine which consists of a) mixing (A) 60–95% by weight of an ester of a hindered alcohol with a straight-chain saturated fatty acid having 8–12 carbon atoms with (B) 5–40% by weight of a complex ester of a hindered alcohol with a straight-chain saturated fatty acid having 8–12 carbon atoms and also with a dibasic acid having 20–50 carbon atoms, and with (C) up to 30 parts by weight of a hydrocarbon based solvent and/or a lubricating based oil and b) applying said mixture to said two-cycle engine.

3. The method according to claim 1 wherein said mixture exhibits a kinematic viscosity of 6–15 $mm^2/s$ at the temperature of 100° C.

4. The method according to claim 2 wherein said mixture exhibits a kinematic viscosity of 6–15 $mm^2/s$ at the temperature of 100° C.

5. The method according to claim 1 wherein said component ( B ) has the formula hereinbelow

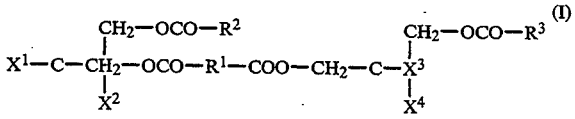

(I)

wherein $X^1$ to $X^4$ are identical or different from each other and each of $X^1$ to $X^4$ is an alkyl group having 1–4 carbon atoms or a group having the $—CH_2—OCO—R^4$ wherein $R^4$ is an alkyl group having 7–11 carbon atoms, $R^1$ is an alkylene or alkenylene group having 18–48 carbon atoms, $R^2$ to $R^4$ are identical or different from each other and each of $R^2$ to $R^4$ is a straight-chain alkyl group having 7–11 carbon atoms.

6. The method according to claim 2 wherein said component (B) has the formula hereinbelow

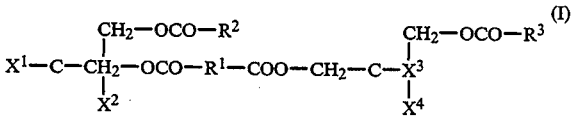

(I)

wherein $X^1$ to $X^4$ are identical or different from each other and each of $X^1$ to $X^4$ is an alkyl group having 1–4 atoms or a group having the $—CH_2—OCO—R^4$ wherein $R^4$ is an alkyl group having 7–11 carbon atoms, $R^1$ is an alkylene or alkenylene group having 18–48 carbon atoms, $R^2$ to $R^4$ are identical or different from each other and each of $R^2$ to $R^4$ is a straight-chain alkyl group having 7–11 carbon atoms.

7. The method according to claim 1 wherein said hindered alcohol is an alcohol having the carbon atom in the $\beta$ position a quaternary carbon atom.

8. The method according to claim 2 wherein said hindered alcohol is an alcohol having the carbon atom in the $\beta$ position a quaternary carbon atom.

* * * * *